US005762389A

United States Patent [19]

Marler

[11] Patent Number: 5,762,389

[45] Date of Patent: Jun. 9, 1998

[54] APPARATUS FOR LATCHING AND UNLATCHING A LOAD SUSPENDED FROM A LIFTING LINE

[76] Inventor: Joseph E. Marler, P.O. Box 134, Livingston, La. 70754

[21] Appl. No.: 657,933

[22] Filed: May 30, 1996

[51] Int. Cl.[6] ..... B66C 1/16

[52] U.S. Cl. ..... 294/75; 294/81.55; 294/81.56; 294/82.35

[58] Field of Search ..... 294/68.3, 75, 81.5, 294/81.54–81.56, 82.27, 82.35; 24/600.4–600.8, 601.6

[56] References Cited

U.S. PATENT DOCUMENTS

| | | | |
|---|---|---|---|
| 1,198,139 | 9/1916 | Lyon | 294/82.35 |
| 1,908,146 | 5/1933 | Helton | 294/82.35 X |
| 2,293,653 | 8/1942 | Katz | 294/83 |
| 2,673,116 | 3/1954 | Baird | 294/75 |
| 2,864,644 | 12/1958 | Marryatt | 294/81.56 X |
| 2,998,277 | 8/1961 | Himel | 294/75 |
| 3,343,862 | 9/1967 | Holmes | 294/81.55 X |
| 3,895,836 | 7/1975 | Barnes | 294/82.35 |
| 4,148,514 | 4/1979 | McCullough | 294/83 R |
| 5,152,567 | 10/1992 | Raber | 294/82.35 |

FOREIGN PATENT DOCUMENTS

| | | | |
|---|---|---|---|
| 2325689 | 12/1973 | Germany | 294/81.56 |
| 152295 | 1/1962 | U.S.S.R. | 294/82.35 |
| 903828 | 8/1962 | United Kingdom | 294/82.35 |

*Primary Examiner*—Johnny D. Cherry
*Attorney, Agent, or Firm*—Domingue, Delaune & Waddell

[57] ABSTRACT

An apparatus for releasing an attached load, with the load being attached with a sling is described. Generally, the apparatus comprises a plate having an underside face, and a latch member, operatively associated with the underside face, for latching and unlatching the sling from the load. The apparatus may contain an activating line attached with the latch member, and activating member, operatively associated with the activating line, for activating the latch member. The apparatus may further comprise a spreader bar that is selectively attached to the plate. In the preferred embodiment, the latch member comprises a first member mounted on the plate, with the member having an opening therein, a second member mounted on the plate, with the member having an opening therein, and a third member mounted on the plate, with the member having an opening therein.

3 Claims, 4 Drawing Sheets

APPARATUS FOR LATCHING AND UNLATCHING A LOAD SUSPENDED FROM A LIFTING LINE

BACKGROUND OF THE INVENTION

This invention relates to a device used for loading and unloading of material. More particularly, but not by way of limitation, this invention relates to an apparatus used to latch and unlatch a load of material suspended from a lifting line.

In the construction, manufacture, and/or general maintenance of industrial facilities, the operators will find it necessary to move various types of loads. This type of movement involves the lifting of equipment, structural members and very heavy cargo. Due to the weight and nature of the equipment, structural members and cargo, and its interaction with the human operators, various surety standards have been developed in order to aid in the safety of the worker. One such regulation is known as the "100% TIE-OFF". Basically, this requires for tieing off the worker to a fixed point via a connecting line and a harness worn by the worker. The "100% TIE-OFF is applicable when the worker is off the ground 6 feet or higher.

The added safety features, however, may also effect the productivity. The worker, therefore, has to stay tied off while six feet or more off the ground, 100% of the time. As the material is moved from a first position to a second position, the rigging must be rigged-up or rigged-down, depending on the sequence of the operation. Thus, the moving of material from one point to a second point is slowed. Of course, the other associated workers and machinery (crane, operator, ground crew, etc.) are in a stand-still while the connector rigs down the connection and then maneuvers to the sling which carried the load up to him.

Thus, there is a need for a device that functions as a latching and unlatching mechanism that allows the worker to safely and efficiently release the sling means after the material, equipment and/or cargo have been properly positioned. There is also a need for an apparatus that is safer and quicker from the viewpoint of the worker so that the overall worker movement about the construction site is decreased.

SUMMARY OF THE INVENTION

An apparatus for releasing an attached load, with the load being attached with a sling means for carrying loads, is described. Generally, the apparatus comprises a plate having an underside face; and latch means, operatively associated with the underside face, for latching and unlatching the sling from the load. The apparatus may contain an activating line attached with the latch means; and activating means, operatively associated with the activating line, for activating the latch means.

The apparatus may further comprise a spreader bar that is selectively attached to the plate. The sling means includes a first sling having a first end connected to a crane and a second end connected to the spreader; a second sling having a first end connected to a crane and a second end connected to the spreader; and, a third sling having a first end connected to the latch means and a second end connected to the load so that the latch means upon activation, releases the third sling.

In the preferred embodiment, the latch means comprises a first member mounted on the plate, with the member having an opening therein, a second member mounted on the plate, with the member having an opening therein, and a third member mounted on the plate, with the member having an opening therein. In this embodiment, the first member and second member form a first chamber to receive the first end of the third sling, and the second member and the third member form a second chamber. A rod is slidably disposed within said openings of the first, second and third member thereby forming the chamber area. A biasing means, disposed about the rod, for biasing the rod into a closed position and in engagement with the openings of the first, second and third members is also provided.

In the preferred embodiment, the activating means comprises an orienting plate operatively attached to the spreader bar along with a pulley member mounted on the orienting plate. In this embodiment, the activating line is operatively associated with the pulley member.

An advantage of the present invention includes making the loading and unloading of equipment, material and cargo safer. The loading and unloading may also be done faster and more efficient. Another advantage is the device may be used with a spreader bar. Another advantage is the types of loads the device may be used with vary widely. For instance, the device may be used for positioning large beams, rafters, or joists. Alternatively, the device may be used while loading or unloading containers, vessels and tanks. The device may be used in the construction of structures and buildings, or in the petro-chemical business, or in the offshore drilling of wells. This list is meant to be illustrative.

Still yet another advantage is that the invention may be used to suit a varying capacity. Yet another advantage is that an additional safety latch with a release cord can be added for added surety against accidental release. The device itself may be bolted or welded to the top of vessels and/or containers, and used therewith for the lifting and/or lowering of those vessels and/or containers. These and many other advantages will become apparent following the detailed description of the preferred embodiments.

BRIEF DESCRIPTION OF THE PREFERRED EMBODIMENTS

DESCRIPTION OF THE PREFERRED EMBODIMENTS

Figure 1A:
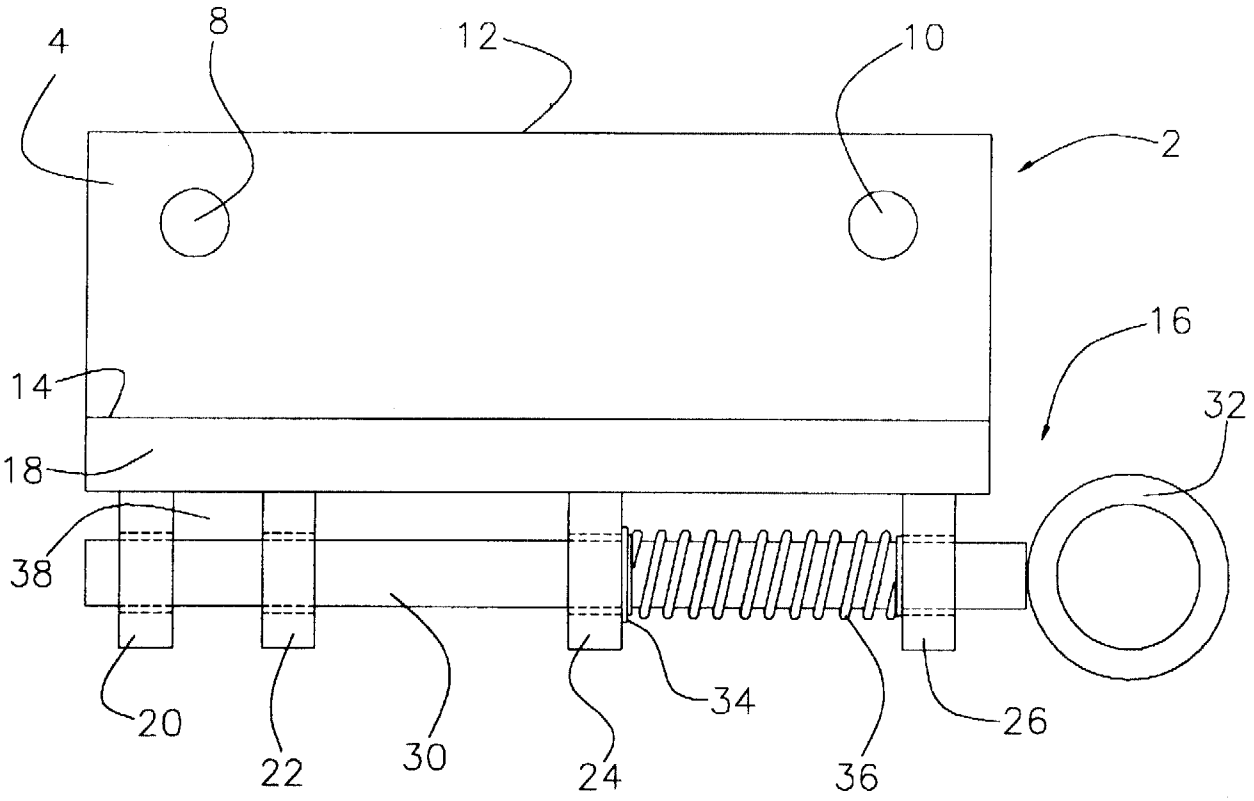
FIG. 1A is front elevation view of the releasing apparatus of the present invention.
Figure 1B:
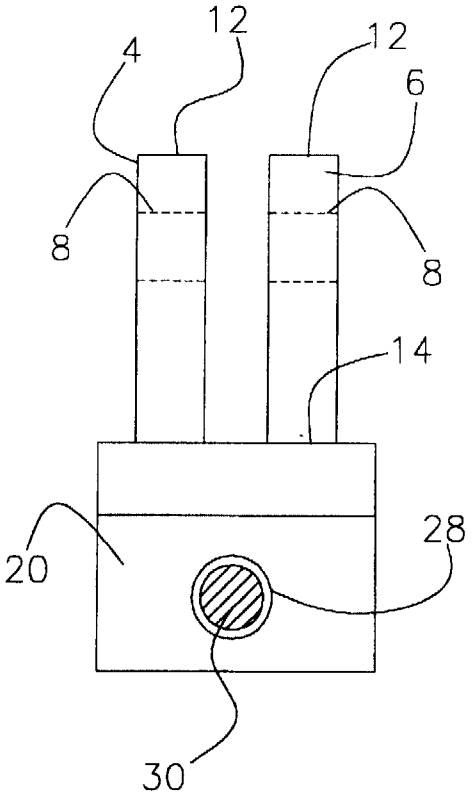
FIG. 1B is a side elevation view of the apparatus of FIG. 1A.

Referring to FIG. 1A, a front elevation view of the releasing apparatus 2 of the present invention is illustrated. The apparatus 2 will contain a first plate 4 and a second plate 6, with the plates 4, 6 having contained therein openings 8 and 10 for placements of a securing means (not shown) such as a bolt. As depicted, the plates 4 and 6 are rectangular with an upper side 12 and an underside 14.

The underside 14 has attached thereto the latch means 16 for latching and unlatching a sling means (see FIG. 2) that is operatively associated with the load being transported. As seen in FIG. 1A, the latch means has a generally rectangular plate 18 that will have extending laterally therefrom a first member 20, a second member 22, a third member 24, and a fourth member 26. The members 20–26 will have formed therein openings 28.

A rod 30 is positioned through the openings 28, as shown in the various figures. The rod 30 has a first end 32 that in the preferred embodiment is a circular handle member. The rod 30 will have attached thereto a washer 34 that in turn has abutting biasing means 36 for biasing the rod into the closed position as seen in FIG. 1A. In the preferred embodiment, the biasing means 36 is a coil spring 36 that biases the rod 30 closed. Thus, with the biasing means 36 slidably disposed about the rod 30, the latch means 16 is positive acting, i.e. the operator must exert a pulling force on the handle member 32 in order to pull the rod 30 into an open position (also referred to as the released position).

As shown in FIG. 1A, a chamber 38 is formed relative to the rod 30 and members 20, 22 while the rod 30 is in the closed position. It should be noted that the member 24 has been added to the preferred embodiments so that the rod 30 better aligns with the openings 28 as well as for structural support. As will be more fully set out hereinafter, the sling means may be inserted into the chamber 38. Thus, when the rod is pulled via handle end 32, the operator may insert the sling into the chamber 38, or alternatively, the operator may withdraw the sling from the chamber 38.

Figure 2:
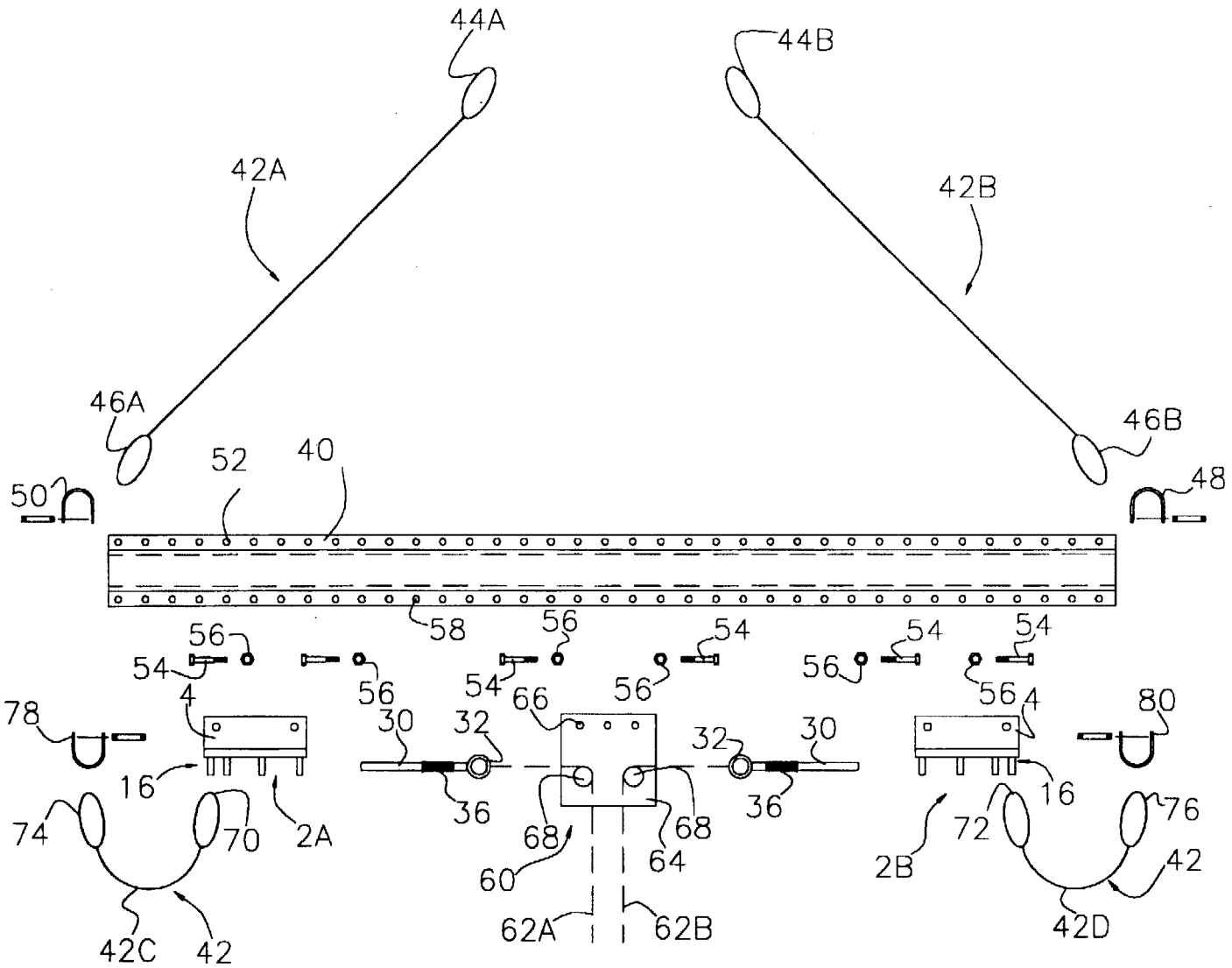
FIG. 2 is a front elevation view of the apparatus of the present invention with a spreader bar and sling means.

Referring now FIG. 2, a front elevation view of the apparatus 2 of the present invention with a spreader bar 40 and sling means 42 is illustrated. It should be noted that the system of FIG. 2 is one system by which the apparatus 2 of the present invention may be utilized. The device 2 itself may be bolted or welded to the top of vessels and/or containers, and used therewith for the lifting and/or lowering of those vessels and/or containers. Further, it should also be noted that throughout the application, like numbers in the various figures refer to like components.

As will be understood by those of ordinary skill in the art, the sling means 42A and 42B will have first ends 44A and 44B that may be attached, for instance, to a means for lifting a load such as a crane (not shown). The second ends 46A and 46B of the sling means 42A and 42B will be attached to the spreader bar 40 via shackles 48 and 50. The shackles 48, 50 fit through the upper series of apertures 52 contained on said spreader bar 40.

As depicted in FIG. 2, there are two (2) apparatus (designated as 2A and 2B) that are attached to the spreader bar 40. The apparatus 2A and 2B are attached via the bolts 54 and nuts 56, with the bolts 54 being inserted into the lower series of apertures 58 and thereafter screwed into place via nuts 56.

FIG. 2 also illustrates the activating means 60 for activating the latch means 16. The activating means will include an activating line 62A and 62B, with the activating line 62A and 62B having one end attached to the handle 32. Thus, each latch means 16 is independently activated. The activating means 60 will include an orienting plate 64 which will have contained therein apertures 66 for placement of a nut 56 and bolt 54 so that the orienting plate 64 will be attached to the spreader bar 40. The orienting plate 64 will also contain the pulley members 68, with the pulley members 68 being mounted on the orienting plate 64 such that the pulleys 68 are rotatable.

Thus, as the operator exerts a pulling force on the activating line 62A and/or 62B, the positive acting latch means 16 will cause the rod 30 to move so that the chamber 38 is opened. The pulleys 68 also allow for the activating line 62A, 62B to be in a horizontal plane relative to the handle end 32 so that the pull force is in the plane of the rod 30. Note that in this embodiment, the two separate activating lines 62A, 62B are independent of each other.

Also shown in FIG. 2 are the sling means 42C and 42D. The end 70 and end 72 of the slings 42C and 42D, respectfully, will cooperate and fit into the previously described chamber 38. The opposite ends of the slings 42C, 42D are ends 74 and 76. The ends 74 and 76 may be attached to the actual load to be lifted such as the joist seen in FIG. 3 via the shackles 78 and 80 as is well understood by those of ordinary skill in the art.

Figure 3:
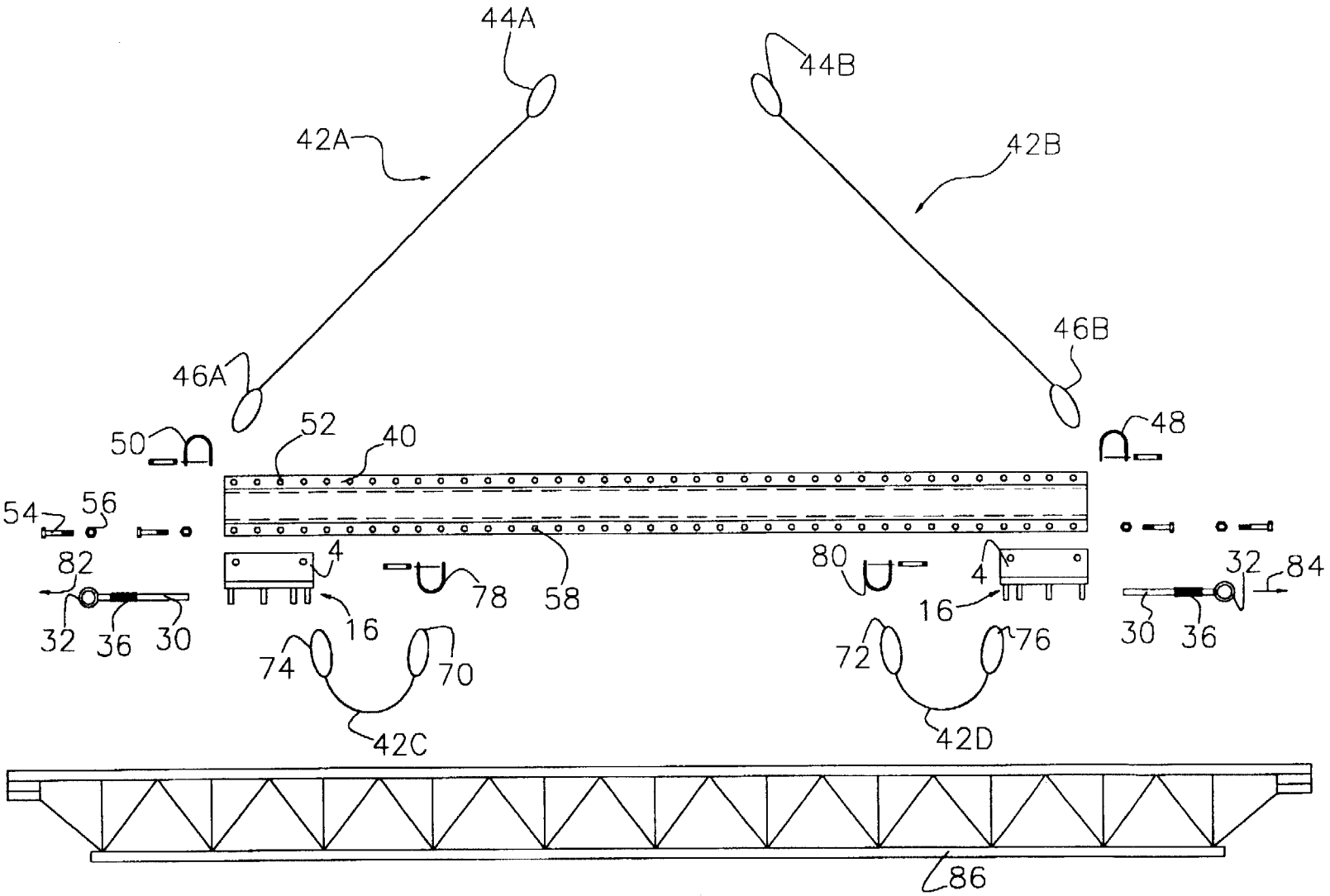
FIG. 3 is another system of the present invention along with a joist member.

Referring now to FIG. 3, a second embodiment of the system herein disclosed is shown. The embodiment shown in FIG. 3 depicts the apparatus 2 oriented in a 180 degree rotated planar position as compared to the system of FIG. 2. Thus, the handle ends 32 must be pulled from the opposite direction as noted by the arrows 82 and 84. FIG. 3 also depicts the bar joist 86 which characterizes the load to be lifted and/or moved and/or supported. The operator would utilize the slings 42C and 42D for such lifting, moving and/or supporting.

The system of FIG. 3 would require attachment of the first plate 4 with the apertures 58 of the spreader bar 40 as previously described. The ends 74 and 76 are placed into the chamber 38. This is performed by exerting a pulling force 82, 84 on the handle end 32 thereby displacing the rod 30 sufficiently to place the ends 74 and 76 into the chamber 38. The sling means 42C and 42D are then passed through the bar joist 86 (as is well understood by those of ordinary skill in the art). Thereafter, the ends 70 and 72 are attached to the spreader bar 40 via the shackles 78 and 80 with the end 70 being associated with the shackle 78, and the end 72 being associated with the shackle 80.

Figure 4:
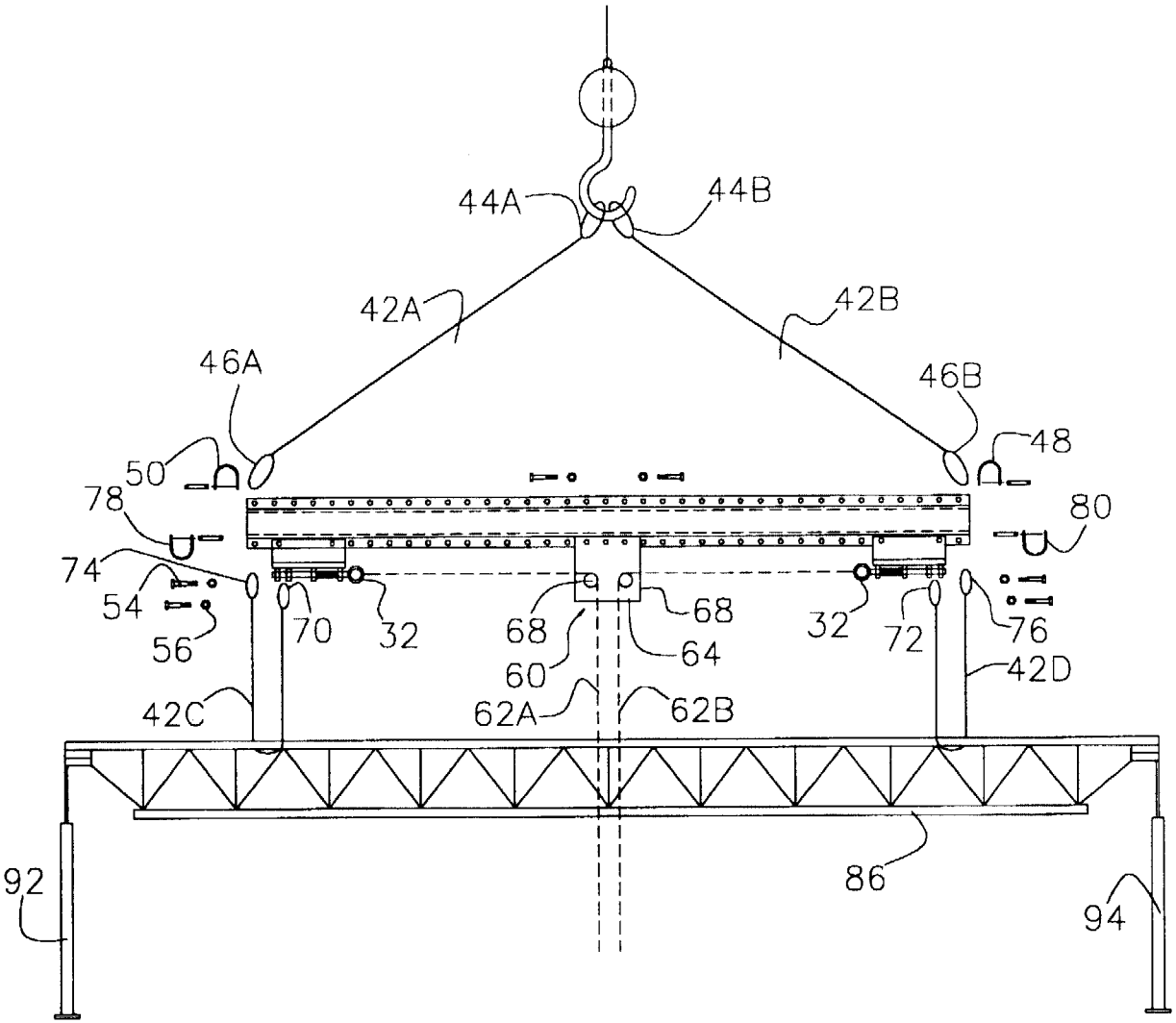
FIG. 4 is the system of FIG. 3 being positioned with a crane at a construction site.

With reference to FIG. 4, the system of the preferred embodiment of the present invention is depicted. Thus, the sling means 42A and 42B are attached at one end 44A and 44B to a crane hook 88, with the crane hook being ultimately attached to a crane line 90. The second ends 46A and 46B are attached to the spreader bar 40 via the shackles 48, 50. The apparatus 2 is also attached to the spreader bar 40 as previously described. The sling means 42C and 42D are looped about the bar joist 86. The ends 70 and 72 will be placed into the chamber 38 as previously described. The ends 74 and 76 will be attached to the spreader bar 40 via shackles 78, 80.

Also depicted in FIG. 4 is the columns 92 and 94 that will have the bar joist 86 positioned thereon. The dimensions shown are a height of approximately 20 feet and a length of 40 feet. However, these dimensions are meant to be illustrative, and the invention is applicable to dimensions both smaller and larger than those shown.

FIG. 4 is an example of the apparatus 2 being used with a spreader bar 40 and related rigging to handle a long span bar joist 86. In some cases, the bar joists are fabricated in excess of 100 feet in length. They generally are not very stable until all bracing is installed and present a problem to the erector when it is time to release the rigging. The problem is magnified when the crane operator is working in the "blind", such as the case when the crane operator can not see the rigging to be released. When using the apparatus 2 of the present invention, when the load is slacked, a pull by the operator on the activating lines 62A and 62B will cause the rod 30 to shift laterally via the activating means 60 so that the chamber 38 is opened thereby allowing the ends 70 and 72 to fall out. Thus, the rigging is released and the crane is again swinging for the next piece. While a bar joist 86 is used, the apparatus 2 is certainly applicable to use with beams, bents, vessels, etc.

The apparatus 2 can be fabricated of A-36 grade steel or molded similar to the common shackles. Further, the apparatus 2 can be designed to a varying degree of capacity to suit a wide variety of needs. An additional safety latch with a release cord can be added for added surety against an accidental release for some unknown reason.

The foregoing description is provided for illustrating purposes only and is not considered limiting. Numerous additions, substitutions and other modifications can be made without departing from the spirit and scope of the present invention.

I claim:

1. An apparatus for releasing an attached load, the apparatus comprising:

sling means for attaching the load and, wherein the sling means comprises: a first sling having a first end connected to a hook of a crane and a second end connected to a spreader bar; a second sling having a first end connected to the hook of the crane and a second end connected to said spreader bar; a third sling having a first end connected to a latch means for latching and unlatching the sling means and a second end connected to the load so that said latch means upon activation releases said third sling;

a plate having an underside face;

latch means, attached to said underside face, for latching and unlatching the third sling from the load and wherein said latch means comprises: a first member mounted on said plate, with said first member having a first opening therein, a second member mounted on said plate, with said second member having a second opening therein, and a third member mounted on said plate, with said third member having a third opening therein and wherein said first member and second member form a first chamber to receive the first end of said third sling, and said second member and said third member form a second chamber; a rod slidably disposed within said first, second, and third openings of said first, second and third members biasing means, disposed about said rod, for biasing said rod into engagement with said first, second, and third openings of said first, second and third members;

an activating line attached with said latch means;

activating means, attached to said spreader bar, for activating said latch means;

and wherein said spreader bar has a first end and a second end, and wherein said plate is selectively attached to said first end of said spreader bar.

2. The apparatus of claim 1 wherein said activating means comprises:

an orienting plate operatively attached to said spreader bar and wherein said orienting plate is separate from said latch means;

a pulley member mounted on said orienting plate;

and wherein said activating line is placed through said pulley member.

3. A system for latching and unlatching an attached load, the system comprising:

a sling means for carrying the load and, wherein the sling means comprises:

a first sling having a first end connected to a hook of a crane and a second end connected to a spreader bar;

a second sling having a first end connected to a hook of a crane and a second end connected to said spreader bar;

a third sling having a first end connected to a latch means for latching and unlatching the sling means and a second end connected to the load so that said latch means upon activation, release said third sling;

latch means, attached to said spreader bar, for latching and unlatching the third sling from the load and, wherein said latch means comprises:

a first member mounted on a plate, with said first member having a first opening therein, a second member mounted on said plate, with said second member having a second opening therein, and a third member mounted on said plate, with said third member having a third opening therein and wherein said first member and second member form a first chamber to receive the first end of said third sling, and said second member and said third member form a second chamber;

a rod slidably disposed within said first, second, and third openings of said first, second and third members, said rod having a first end and a second end;

biasing means, disposed about said rod, for biasing said rod into engagement with said first, second, and third openings of said first, second and third members;

an activating line attached with said second end of said rod;

activating means, attached to said spreader bar, for activating said latch means and, wherein said activating means comprises:

an orienting plate operatively attached to said spreader bar;

a pulley member mounted on said orienting plate;

and wherein said activating line is operatively associated with said pulley member.

* * * * *